US009035982B2

(12) United States Patent
Otana

(10) Patent No.: US 9,035,982 B2
(45) Date of Patent: May 19, 2015

(54) OPTICAL SCANNING DEVICE AND IMAGE FORMING APPARATUS USING SAME

(71) Applicant: KYOCERA Document Solutions Inc., Osaka-shi, Osaka (JP)

(72) Inventor: Aiichiro Otana, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 14/445,481

(22) Filed: Jul. 29, 2014

(65) Prior Publication Data

US 2015/0035931 A1 Feb. 5, 2015

(30) Foreign Application Priority Data

Jul. 31, 2013 (JP) ..... 2013-158943

(51) Int. Cl.
*G03G 15/043* (2006.01)
*G03G 15/04* (2006.01)

(52) U.S. Cl.
CPC ..... *G03G 15/0435* (2013.01)

(58) Field of Classification Search
CPC ... B41J 2/471; H04N 1/1135; G02B 27/0031; G02B 26/125; G06K 15/1204; G03G 15/0435
See application file for complete search history.

(56) References Cited

U.S. PATENT DOCUMENTS

| | | | | |
|---|---|---|---|---|
| 8,237,759 | B2 * | 8/2012 | Hwang | 347/235 |
| 2002/0021346 | A1 * | 2/2002 | Ishihara | 347/129 |
| 2006/0139715 | A1 * | 6/2006 | Tamaru et al. | 359/204 |
| 2007/0091404 | A1 * | 4/2007 | Miyamoto | 359/204 |
| 2011/0205610 | A1 * | 8/2011 | Okamura et al. | 359/201.2 |
| 2011/0298882 | A1 * | 12/2011 | Otana et al. | 347/118 |

FOREIGN PATENT DOCUMENTS

| | | |
|---|---|---|
| JP | 2006-267701 | 10/2006 |

* cited by examiner

*Primary Examiner* — Manish S Shah
*Assistant Examiner* — Jeremy Delozier
(74) *Attorney, Agent, or Firm* — Gerald E. Hespos; Michael J. Porco; Matthew T. Hespos

(57) ABSTRACT

Provided is an optical scanning device including a light source, a deflector, a scanning lens, a synchronizing sensor, a sensor lens and a control unit. The deflector causes a scanning line to be written within an effective scanning width of a surface to be scanned. The synchronizing sensor detects a light beam that is outside the range of the effective scanning width on a scanning start side of the scanning line. The control unit controls an emission operation of the light source, and starts the writing of the scanning line at a timing in which a fixed time is added to a timing that the synchronizing sensor has detected the light beam. The sensor lens includes a diffraction grating that bends the light beam in a downstream-side direction of the scanning line, and a bending degree of the light beam by the diffraction grating changes with temperature.

6 Claims, 10 Drawing Sheets

OPTICAL SCANNING DEVICE AND IMAGE FORMING APPARATUS USING SAME

This application relates to and claims priority from Japanese Patent Application No. 2013-158943, filed with the Japan Patent Office on Jul. 31, 2013, the entire disclosure of which is incorporated herein by reference.

BACKGROUND

The present disclosure relates to an optical scanning device including a scanning lens for imaging a light beam on a surface to be scanned, and to an image forming apparatus using the optical scanning device.

A standard optical scanning device that is used in, for example, laser printers and copiers includes a light source that emits a laser beam, a polygon mirror that deflects the laser beam and causes the laser beam to scan the surface to be scanned, and a scanning lens that images the deflected laser beam on a peripheral surface (surface to be scanned) of a photoconductive drum. The lens power of the scanning lens changes according to a change in temperature. For example, when the environmental temperature of the optical scanning device rises, the lens power will decrease, and a magnification error of a broader scanning width will consequently occur. This magnification error causes the image quality to deteriorate.

Generally speaking, an optical scanning device includes a synchronizing sensor that detects a laser beam outside the range of the scanning width for determining the writing position of the scanning line. After the lapse of a fixed time after the synchronizing sensor detects a laser beam, writing on the surface to be scanned by the scanning line is started. Accordingly, even when the foregoing magnification error occurs, the writing position of the scanning line will be the home position during a normal temperature. Nevertheless, the write end position will be affected by the foregoing magnification error.

Known is an optical scanning device that rotates a reflecting mirror, in accordance with the environmental temperature, which guides a laser beam to the synchronizing sensor in order to suppress the magnification error.

SUMMARY

The optical scanning device according to one aspect of the present disclosure includes a light source that emits a light beam having a wavelength that changes with temperature, a deflector, a scanning lens, a synchronizing sensor, a sensor lens and a control unit.

The deflector deflects the light beam emitted from the light source and causes the light beam to scan a range of a predetermined scannable width including a surface to be scanned, and causes a scanning line to be written within an effective scanning width that is set within the range of the scannable width. The scanning lens is disposed between the deflector and the surface to be scanned, and images the light beam on the surface to be scanned. The synchronizing sensor detects, of light beams that pass through the scanning lens and head toward the range of the scannable width, a light beam that is outside the range of the effective scanning width on a scanning start side of the scanning line. The sensor lens is disposed between the deflector and the synchronizing sensor, and images the light beam on the synchronizing sensor. The control unit controls an emission operation of the light source, and starts the writing of the scanning line at a timing in which a fixed time is added to a timing that the synchronizing sensor has detected the light beam.

The sensor lens includes a diffraction grating that bends the light beam in a downstream-side direction of the scanning line, and a bending degree of the light beam by the diffraction grating changes with temperature.

The image forming apparatus according to another aspect of the present disclosure includes a first photoconductive drum having a first peripheral surface as surfaces to be scanned, and rotating about an axis, a second photoconductive drum having a second peripheral surface as surfaces to be scanned, and rotating about an axis, a first optical scanning device that is configured from the foregoing optical scanning device and that causes the first peripheral surface to be irradiated with a light beam, and a second optical scanning device that is configured from the foregoing optical scanning device and that causes the second peripheral surface to be irradiated with a light beam.

In the first optical scanning device, the first peripheral surface is scanned with the light beam in a first direction that is a main scanning direction. In the second optical scanning device, the second peripheral surface is scanned with the light beam in a second direction that is opposite to the first direction.

DETAILED DESCRIPTION

Figure 1:
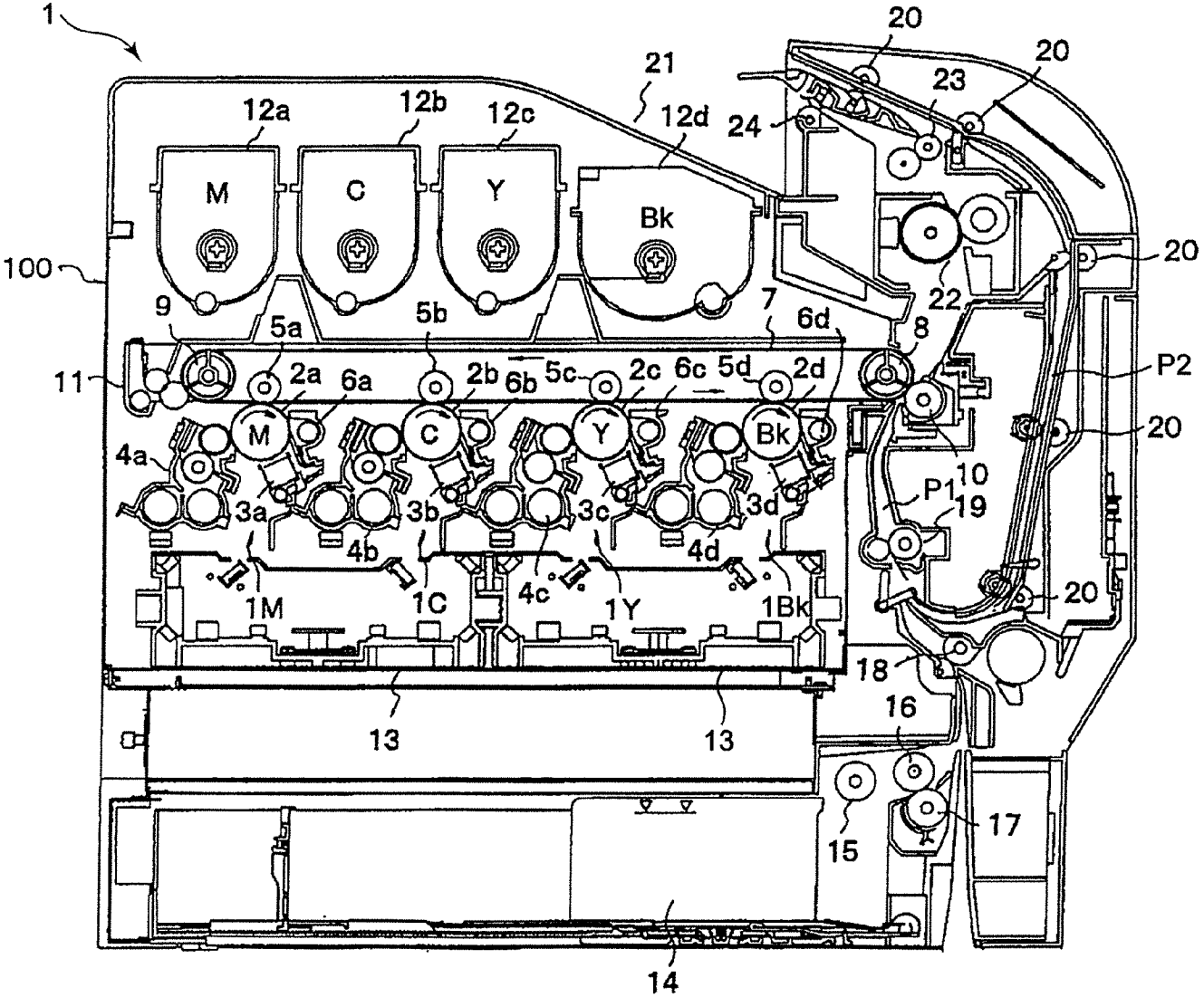
FIG. 1 is a cross section showing a schematic configuration of the image forming apparatus according to an embodiment of the present disclosure.

An embodiment of the present disclosure is now explained with reference to the drawings. FIG. 1 is a cross section of a full color printer 1 according to an embodiment of an image forming apparatus of the present disclosure. The printer 1 is a tandem-type printer, and a magenta image forming unit 1M, a cyan image forming unit 1C, a yellow image forming unit 1Y and a black image forming unit 1Bk are disposed in tandem at regular intervals at the center part in a main body 100.

The image forming units 1M, 1C, 1Y, 1Bk respectively include each of photoconductive drums 2*a*, 2*b*, 2*c*, 2*d*. Charging units 3*a*, 3*b*, 3*c*, 3*d*, developing devices 4*a*, 4*b*, 4*c*, 4*d*, transfer rollers 5*a*, 5*b*, 5*c*, 5*d* and drum cleaning devices 6*a*, 6*b*, 6*c*, 6*d* are respectively disposed around each of the photoconductive drums 2*a* to 2*d*. An intermediate transfer belt 7 and toner containers 12*a*, 12*b*, 12*c*, 12*d* are disposed above, and an optical scanning device 13 is disposed below, the image forming units 1M, 1C, 1Y, 1Bk.

The photoconductive drums 2*a* to 2*d* include a rotation axis extending in a direction that is orthogonal to the plane of paper of FIG. 1, and a cylindrical peripheral surface that carries an electrostatic latent image and a toner image. The photoconductive drums 2*a* to 2*d* are rotatably driven, with a drive motor not shown, about an axis at a rotating speed according to a predetermined process line speed in an arrow direction (clockwise direction) in the diagram. The charging units 3*a* to 3*d* uniformly charge the peripheral surface of the photoconductive drums 2*a* to 2*d* with the charging bias that is applied from the charging bias power source not shown.

The optical scanning device 13 irradiates a laser beam so that each of the peripheral surfaces (surfaces to be scanned) of the uniformly charged photoconductive drums 2*a* to 2*d* is irradiated with the laser beam, and thereby forms an electrostatic latent image corresponding to a color image signal of each color on the peripheral surfaces. This embodiment illustrates an example where two optical scanning devices 13 that commonly use two colors; namely, magenta and cyan, and yellow and black, are disposed in parallel. While described in detail later, the optical scanning device 13 is an optical scanning device based on a counter scanning system.

The developing devices 4*a* to 4*d* respectively supply a magenta (M) toner, a cyan (C) toner, a yellow (Y) toner, and a black (Bk) toner to the peripheral surface of the respective photoconductive drums 2*a* to 2*d*. Based on the foregoing supply, toner of the respective colors is affixed to the respective electrostatic latent images formed on the peripheral surface of the respective photoconductive drums 2*a* to 2*d*, and the respective electrostatic latent images are visualized as the toner image of the respective colors. The toner containers 12*a* to 12*d* respectively supply the toner of the respective colors to the respective developing devices 4*a* to 4*d*. Transfer rollers 5*a* to 5*d* are pressed against the respective photoconductive drums 2*a* to 2*d* via an intermediate transfer belt 7, and form a primary transfer unit. Drum cleaning devices 6*a* to 6*d* clean the peripheral surfaces of the respective photoconductive drums 2*a* to 2*d* after the primary transfer.

The intermediate transfer belt 7 has an outer peripheral surface to which a toner image carried on the peripheral surface of the respective photoconductive drums 2*a* to 2*d* is transferred (primary transfer). The intermediate transfer belt 7 is extended between a drive roller 8 and a tension roller 9, and circulated based on the drive of the drive roller 8. A secondary transfer roller 10 is pressed against the drive roller 8 via the intermediate transfer belt 7 to form a secondary transfer unit. A belt cleaning device 11 is disposed near the tension roller 9.

The printer 1 additionally includes a paper cassette 14 that is detachably mounted near the bottom part of the main body 100, and a conveyance path P1 and a reverse conveyance path P2 disposed near the right side part of the main body 100. The paper cassette 14 houses a plurality of sheets that are subject to image forming processing. Disposed near the paper cassette 14 are a pickup roller 15 for picking up paper from the paper cassette 14, and a feed roller 16 and a retard roller 17 that separate the picked up paper and feed the paper one by one to the conveyance path P1.

The conveyance path P1 is a conveyance path that extends in the vertical direction, and provided on the conveyance pathway thereof are a conveyance roller pair 18 for delivering the sheets, and a resist roller pair 19. The resist roller pair 19 temporarily holds the sheets, and thereafter supplies the sheet to the secondary transfer unit at a predetermined timing. The reverse conveyance path P2 is a conveyance path that is used upon forming an image on either surface of the sheet. A plurality of reverse roller pairs 20 are provided at appropriate intervals to the reverse conveyance path P2.

The conveyance path P1 extends up to a paper output tray 21 provided to the upper surface of the main body 100, and a fixing device 22 and paper discharge roller pair 23, 24 are provided midway in the conveyance path P1. The fixing device 22 includes a fixing roller and a pressure roller, and, by heating and pressing the sheet that passes through a nip part of these rollers, fixing treatment of fixing the toner image on the sheet is performed. The paper discharge roller pair 23, 24 discharges the sheet, which was subject to the fixing treatment, to the paper output tray 21.

The outline of the image forming operation performed by the printer 1 having the foregoing configuration is now explained. When an image forming instruction signal is given, the respective photoconductive drums 2*a* to 2*d* are rotatably driven in the respective image forming units 1M, 1C, 1Y, 1Bk. The surface of these photoconductive drums 2*a* to 2*d* is uniformly charged by the charging units 3*a* to 3*d*. The respective optical scanning devices 13 emit a laser beam that is modulated based on a color image signal of each color, scans the peripheral surface of the respective photoconductive drums 2*a* to 2*d*, and thereby forms the respective electrostatic latent images.

Foremost, a magenta toner is supplied from the developing device 4*a* to the photoconductive drum 2*a* of the magenta image forming unit 1M, and the electrostatic latent image of the photoconductive drum 2*a* is developed as a magenta toner image. The magenta toner image is transferred (primary transfer) onto the intermediate transfer belt 7 in the primary transfer unit between the photoconductive drum 2*a* and the transfer roller 5*a* based on the effect of the transfer roller 5*a* to which is applied a primary transfer bias having a polarity that is opposite to the toner.

Similar development operations are subsequently performed in the cyan, yellow and black image forming units 1C, 1Y, 1Bk. The cyan image, yellow image and black toner image respectively formed on the respective photoconductive drums 2*b*, 2*c*, 2*d* are sequentially transferred in a superimposed manner onto the magenta toner image on the intermediate transfer belt 7 in the respective primary transfer units. A full color toner image is thereby formed on the intermediate transfer belt 7. Note that the residual toner remaining on the respective photoconductive drums 2*a* to 2*d* that is not transferred onto the intermediate transfer belt 7 is removed by the respective drum cleaning devices 6*a* to 6*d*.

The sheet that is fed to the conveyance path P1 from the paper cassette 14 is conveyed to the secondary transfer unit by the resist roller pair 19 at the timing that the full color toner image on the intermediate transfer belt 7 reaches the secondary transfer unit between the drive roller 8 and the secondary transfer roller 10. A full color toner image is collectively transferred (secondary transfer) from the intermediate transfer belt 7 by the secondary transfer roller 10 to which is applied a secondary transfer bias having a polarity that is opposite to the toner.

Thereafter, the sheet is delivered to the fixing device 22, and passes through a fixing nip part. Based on the heating and pressure during the foregoing process, a full color toner image is thermally fixed to the surface of the sheet. The sheet to which the toner image was fixed is discharged onto the paper output tray 21 by the paper discharge roller pair 23, 24, and the sequential image forming operation is thereby completed. The residual toner remaining on the intermediate transfer belt 7 as a result of not being transferred onto the sheet is removed by the belt cleaning device 11.

Figure 2:
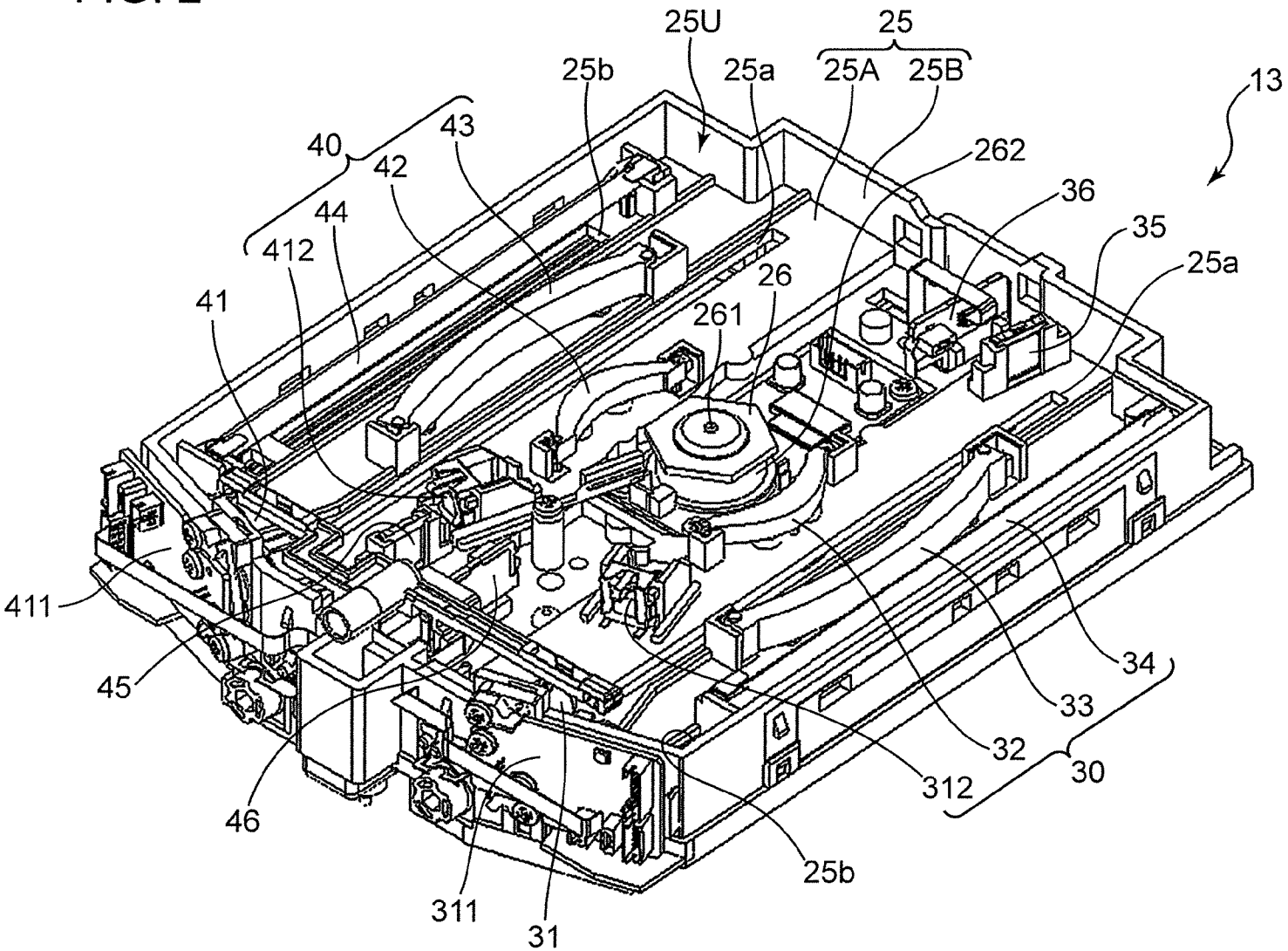
FIG. 2 is a perspective view showing an internal structure of the optical scanning device according to an embodiment of the present disclosure.
Figure 3:
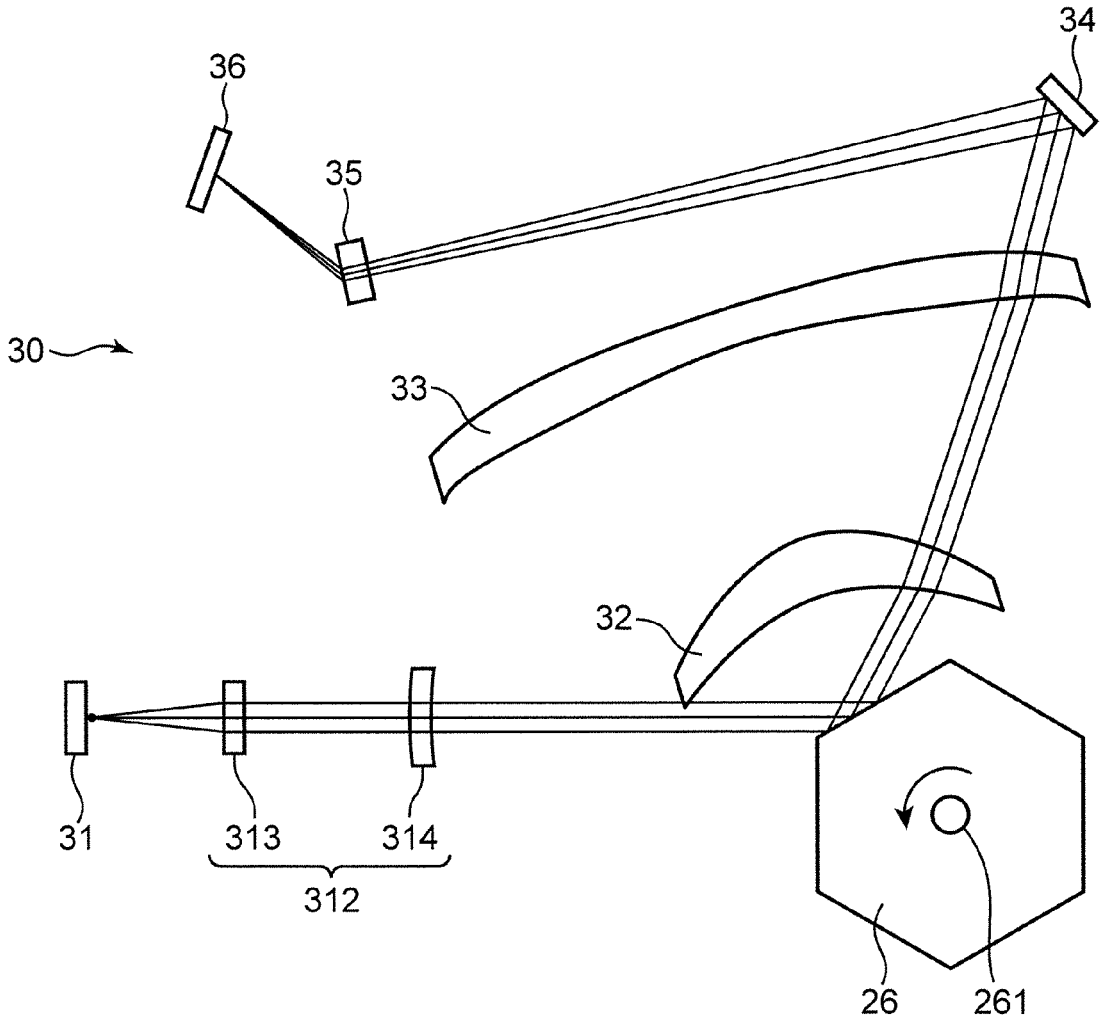
FIG. 3 is a schematic optical path diagram of the optical system included in the optical scanning device.

The detailed structure of the optical scanning device 13 is now explained. Since the basic configuration of the two optical scanning devices 13 provided to the printer 1 shown in FIG. 1 is the same, only one of the optical scanning devices 13 will be illustrated and explained below. FIG. 2 is a perspective view showing the internal structure of the optical scanning device 13, and FIG. 3 is a schematic optical path diagram of the optical system provided in the optical scanning device 13. Note that the one optical scanning device 13 indicated below is used for exposing and scanning the photoconductive drum 2*a* of the magenta image forming unit 1M and the photoconductive drum 2*b* of the cyan image forming unit 1C shown in FIG. 1.

The optical scanning device 13 includes a housing 25 that is integrally formed with resin. The housing 25 includes a base 25A configured from a horizontal flat plate member that partitions its internal space into an upper-side space 25U and a lower-side space (not represented in FIG. 2), and a frame-shaped side wall 25B that surrounds the periphery of the base 25A. While not shown, the opening of the upper-side space 25U is covered by a cover member.

A polygon mirror 26 (deflector) is disposed at the center part of the upper-side space 25U of the housing 25. A first scanning optical system 30 (first optical scanning device) and a second scanning optical system 40 (second optical scanning device), with the polygon mirror 26 disposed therebetween, are disposed symmetrically in the upper-side space 25U and the lower-side space in the housing 25. The first scanning optical system 30 is an optical system that is used for scanning, as the surface to be scanned, the peripheral surface (first peripheral surface) of the magenta photoconductive drum 2*a* (first photoconductive drum), and the second scanning optical system 40 is an optical system that is used for scanning, as the surface to be scanned, the peripheral surface (second peripheral surface) of the cyan photoconductive drum 2*b* (second photoconductive drum). In other words, the optical scanning device 13 of this embodiment is a device based on a counter scanning system in which two scanning optical systems 30, 40 disposed facing each other across one polygon mirror 26 share the one polygon mirror 26.

The polygon mirror 26 includes a plurality of mirror surfaces (six surfaces in this embodiment) for deflecting (reflecting) laser beams (light beams). A rotation axis 261 is inserted through the center of the polygon mirror 26. A polygon motor 262 is connected to the rotation axis 261. The polygon mirror 26 rotates about the rotation axis 261 based on the drive of the polygon motor 262.

The first and second scanning optical systems 30, 40 respectively include a first LD (laser diode) module 31 (light source) and a second LD module 41 (light source) that emit first and second laser beams L1, L2 of a predetermined wavelength. The first and second LD modules 31, 41 include a laser diode, and are disposed in the upper-side space 25U in a state of being mounted on the printed circuit boards 311, 411 installed on a side wall 25B of the housing 25. The optical components of the first and second scanning optical systems 30, 40 are respectively disposed on the optical path of the first and second laser beams from the first and second LD modules 31, 41 to the peripheral surfaces of the magenta and cyan photoconductive drums 2*a*, 2*b*.

The laser diodes used in this embodiment have temperature characteristics in which the oscillation wavelength changes with the temperature. These temperature characteristics are the characteristics where the oscillation wavelength of the laser diode shifts toward the long wavelength as the environmental temperature rises. In other words, when the temperature in the housing 25 rises and the first and second LD modules 31, 41 are heated, the wavelength of the laser beams emitted from these modules 31, 41 become longer. Note that, as the first and second LD modules 31, 41, single beam-type modules or multi beam-type modules may be used.

The first scanning optical system 30 includes an incident optical unit 312, a first scanning lens 32, a second scanning lens 33 and a folding mirror 34. The second scanning optical system 40 includes an incident optical unit 412, a first scanning lens 42, a second scanning lens 43 and a folding mirror 44. These optical components are disposed in the upper-side space 25U (upper surface of the base 25A) of the housing 25. Note that, while not represented in FIG. 2 and FIG. 3, two folding mirrors are respectively disposed in the first and second scanning optical systems 30, 40 on the lower face side of the base 25A. In addition, a sensor lens 35 and a synchronizing sensor 36 are disposed relative to the first scanning optical system 30, and a sensor lens 45 and a synchronizing sensor 46 are disposed relative to the second scanning optical system 40.

Since the first scanning optical system 30 and the second scanning optical system 40 have the same configuration, the respective optical components of the first scanning optical system 30 are now mainly explained with reference to FIG. 3. The incident optical unit 312 includes a collimator lens 313 and a cylindrical lens 314. The collimator lens 313 converts, into parallel light, the laser beam that is emitted from the first LD module 31 and becomes diffused. The cylindrical lens 314 converges the laser beams emitted from the collimator lens 313 in a sub scanning direction, converts this into linear light extending in a main scanning direction, and images the linear light on the mirror surface of the polygon mirror 26. The laser beam emitted from the first LD module 31 enters one mirror surface of the polygon mirror 26. The laser beam emitted from the second LD module 41 enters another mirror surface that differs from the one mirror surface of the polygon mirror 26. Both of these laser beams are respectively deflected in two symmetrical directions based on the respective mirror surfaces.

The first scanning lens 32 and the second scanning lens 33 of the first scanning optical system 30 are lenses having fθ characteristics, and are disposed on the optical path and between the polygon mirror 26 and the peripheral surface (surface to be scanned) of the photoconductive drum 2*a*. The first and second scanning lenses 32, 33 convert the laser beams that were deflected by the mirror surfaces of the polygon mirror 26 into constant speed scanning light, and images the constant speed scanning light on the peripheral surface of the photoconductive drum 2*a*.

These first and second scanning lenses 32, 33 are resin lenses configured by molding transparent resin. Thus, the lens power of the first and second scanning lenses 32, 33 will change according to change in the lens refractive index, lens surface shape, spacing and other factors caused by the change in environmental temperature. For example, when the temperature of the first and second scanning lenses 32, 33 rises, the lens power decreases, and the power that refracts light decreases. This will lead to the expansion of the scanning width, and induce a magnification error.

The folding mirror 34 is a mirror for reflecting the laser beam by bending it 90° so that the laser beam advancing in the horizontal direction along the upper surface of the base 25A will head toward the lower-side space. The base 25A is provided with two openings 25*a*, 25*b*, which are rectangular openings long in the main scanning direction. The laser beam that passed through the second scanning lens 33 is reflected by the folding mirror 34, passes through the opening 25*b*, and heads toward the lower-side space. The laser beam is thereafter bent 90° by each of the two folding mirrors disposed in the lower-side space, passes through the opening 25*a* and returns to the upper-side space 25U, and heads toward the peripheral surface of the photoconductive drum 2*a* disposed immediately above. The laser beam that takes the foregoing pathway is a laser beam that is within the range of the effective scanning width. Meanwhile, a part of the laser beam that is outside the range of the effective scanning width heads toward the sensor lens 35 after being reflected with the folding mirror 34 as shown in FIG. 3.

The sensor lens 35 is disposed on the optical path and between the polygon mirror 26 and the synchronizing sensor 36, and images the laser beam on a light-receiving part of the synchronizing sensor 36. While described in detail later, the sensor lens 35 includes a diffraction grating on at least one surface of its entrance surface or emission surface which bends the laser beam toward the downstream-side direction of the scanning line. The bending degree of the laser beam by the diffraction grating will change based on the environmental temperature. In this embodiment, the timing that the laser beam enters the synchronizing sensor 36 is automatically adjusted by using the change of the bending degree.

The synchronizing sensor 36 is a BD (beam detect) sensor that receives the laser beam and performs photoelectric conversion thereof, and thereby generates a detection signal. The synchronizing sensor 36 detects a laser beam that is outside the range of the effective scanning width on the scanning start side of the scanning line that is drawn on the peripheral surface of the photoconductive drum 2*a*. The detection signal of the synchronizing sensor 36 is used for determining the starting position of the scanning line. In other words, the writing of the scanning line on the peripheral surface of the photoconductive drum 2*a* is started after the lapse of a fixed time after the synchronizing sensor 36 detects the laser beam.

Figure 4:
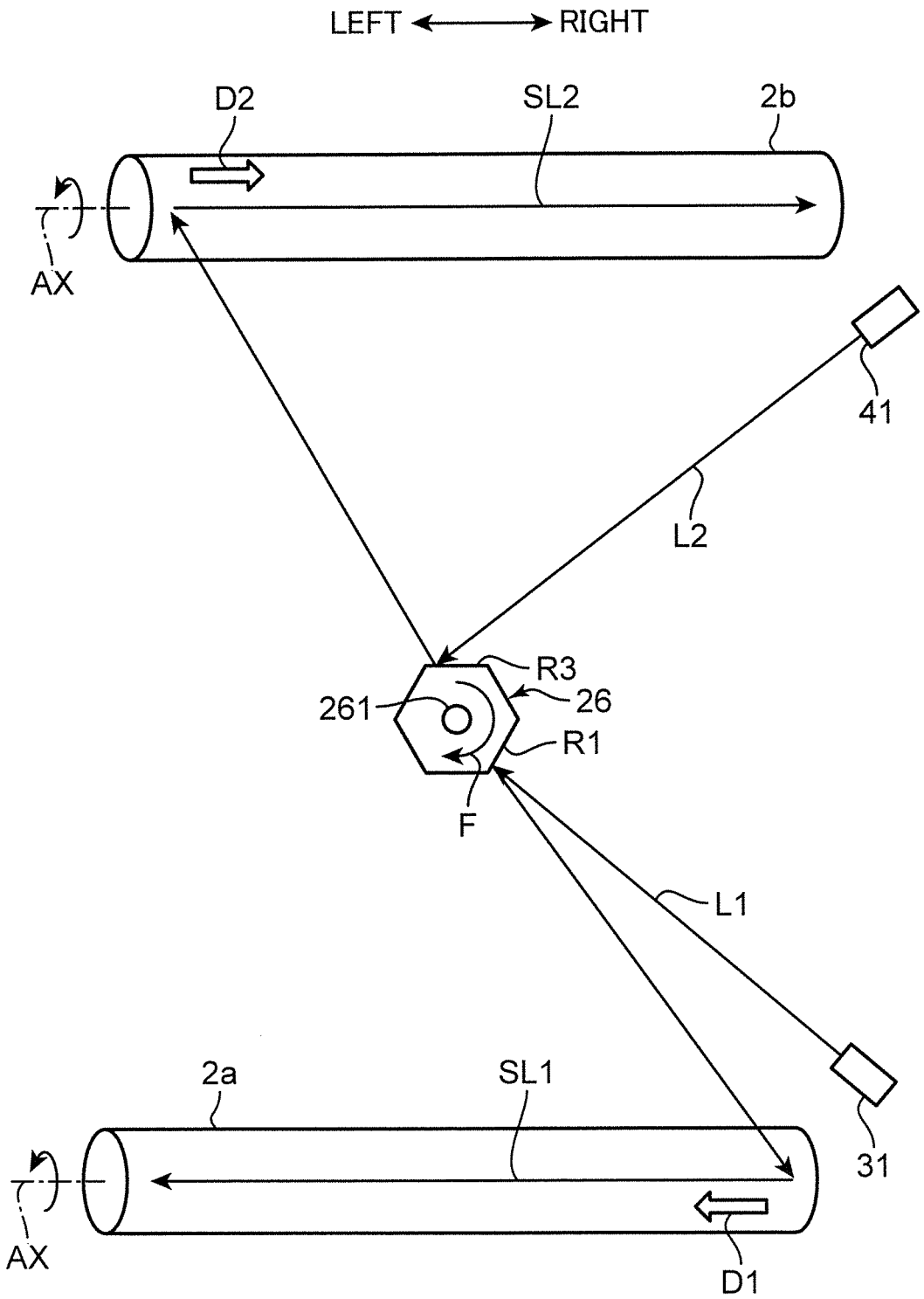
FIG. 4 is a schematic diagram explaining the scanning of the drum peripheral surface based on the counter scanning system.

The configuration of the first scanning optical system 30 is as described above. The second scanning optical system 40, the sensor lens 45 and the synchronizing sensor 46 are also configured as described above. The optical scanning device 13 of this embodiment adopts a counter scanning system in which one polygon mirror 26 is shared by two optical systems; namely, the first scanning optical system 30 and the second scanning optical system 40. This counter scanning system is now explained with reference to FIG. 4. FIG. 4 is a schematic diagram explaining the scanning of the peripheral surface of the photoconductive drums 2*a*, 2*b* by the counter scanning system.

A first laser beam L1 emitted from the first LD module 31 of the first scanning optical system 30 enters a first mirror surface R1 of the polygon mirror 26 that is being rotatably driven about the rotation axis 261 at a predetermined speed in an arrow F direction. Meanwhile, a second laser beam L2 emitted from a second LD module 41 enters a third mirror surface R3 of the polygon mirror 26. The third mirror surface R3 is a surface in which the surface direction differs by 120° relative to the first mirror surface R1 when viewed about the rotation axis 261.

The first laser beam L1 and the second laser beam L2 are deflected (reflected) in two symmetrical directions relative to the polygon mirror 26, and the first laser beam L1 is imaged on the peripheral surface near the right end of the magenta photoconductive drum 2*a* and the second laser beam L2 is imaged on the peripheral surface near the left end of the cyan photoconductive drum 2*b*, respectively. The first and second laser beams L1, L2 are converted into constant speed scanning light by passing through the first scanning lenses 32, 42 and the second scanning lenses 33, 43 during the foregoing imaging.

The first laser beam L1 scans the peripheral surface of the magenta photoconductive drum 2*a* rotating about a rotation axis AX in a first direction D1 from the right end to the left end with the right end as the starting position, and draws (exposes) a scanning line SL1. Meanwhile, the second laser beam L2 scans the peripheral surface of the cyan photoconductive drum 2*b* rotating about a rotation axis AX in a second direction D2 from the left end to the right end with the left end as the starting position, and draws scanning line SL2. In other words, the first and second laser beams L1, L2 draw the scanning lines SL1, SL2 in mutually opposing directions. In this respect, this drawing system is referred to as the counter scanning system.

The scanning lines SL1, SL2 are subject to a color drift when they do not overlap without any deviation in both the main scanning direction and the sub scanning direction. Nevertheless, in the counter scanning system, since the scanning directions of the scanning lines SL1, SL2 are mutually opposing directions, the overlap deviation of both lines tends to occur when the foregoing magnification error occurs. The optical scanning device 13 of this embodiment has a function of suppressing, as much as possible, the foregoing color drift by interposing a sensor lens 35 including a diffraction grating. This point is now explained.

Figure 5:
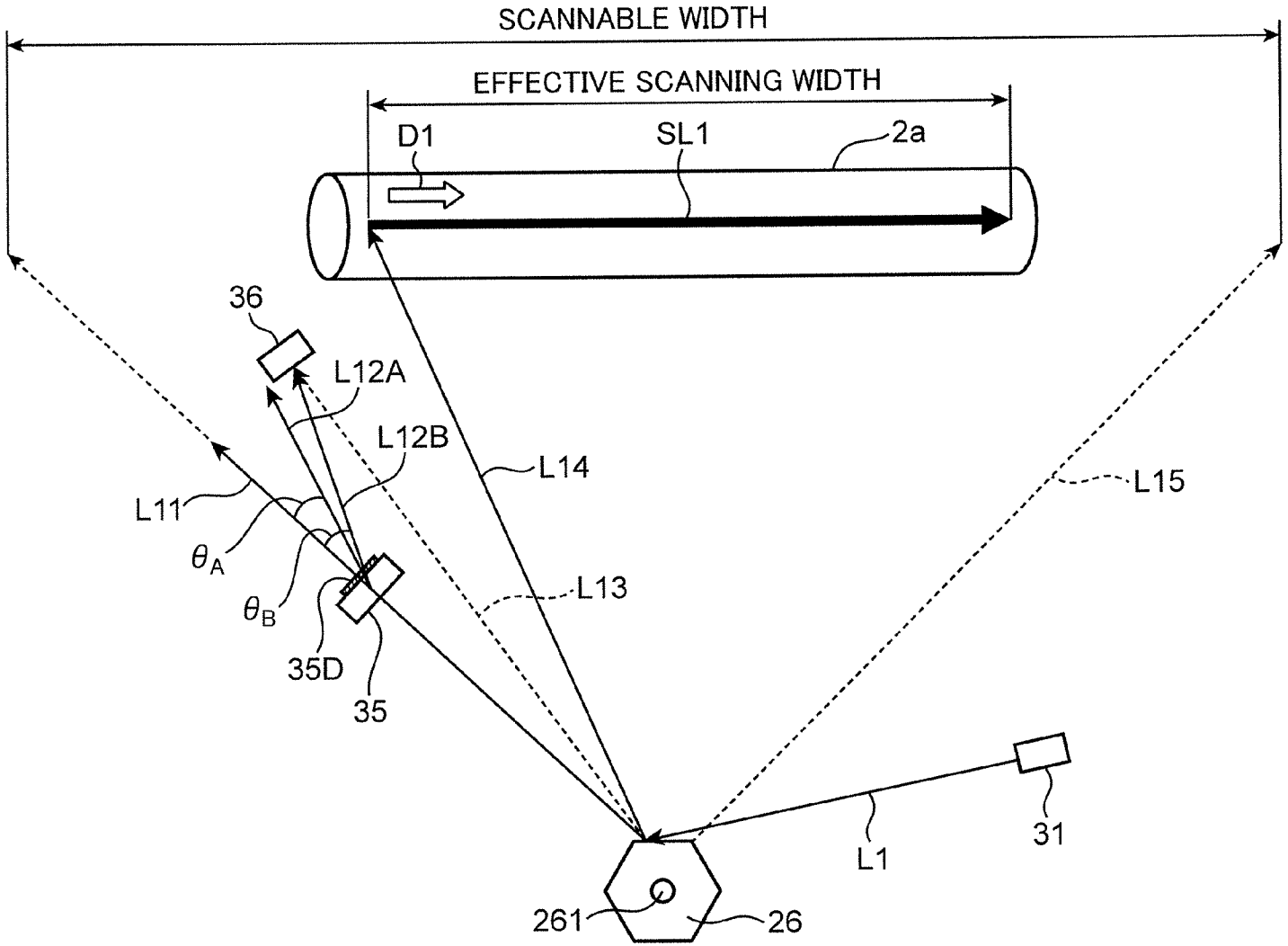
FIG. 5 is a schematic diagram explaining the operation of the optical scanning device.

FIG. 5 is a schematic diagram explaining the operation of the optical scanning device 13. When one mirror surface of the polygon mirror 26 deflects the laser beam L1, the range in which the deflected laser beam L1 can scan by passing through the first and second scanning lenses 32, 33 (not shown in FIG. 5) (this range is hereinafter referred to as the "scannable width" in the specification) is wider than the effective scanning width on the peripheral surface of the photoconductive drum 2*a*. The effective scanning width is the width of the main scanning direction on the peripheral surface where the scanning line SL1 (electrostatic latent image) is written. The scannable width extends more toward the upstream side than the upstream end of the effective scanning width and extends more toward the downstream side than the downstream end of the effective scanning width when viewed in the scanning direction (first direction D1). In FIG. 5, the light beam that is most deflected toward the upstream side is indicated as L11, and the light beam that is most deflected toward the downstream side is indicated as L15. In other words, the space between the light beam L11 and the light beam L15 is the scannable width, and the effective scanning width is set within the range of the scannable width.

The synchronizing sensor 36 is disposed at a position of receiving a laser beam, among the light beams that pass through the first and second scanning lenses 32, 33 and head toward the range of the scannable width, on the upstream side (outside the effective scanning width) that is more upstream than the upstream end (scanning start side of the scanning line SL1) of the effective scanning width. In FIG. 5, the light beam heading toward the upstream end of the effective scanning width is indicated as L14, and the synchronizing sensor 36 is disposed on a virtual line L13 between the light beam L11 and the light beam L14.

The sensor lens 35 is disposed at a position where the light beam enters which is more on the upstream side than the virtual line L13. The sensor lens 35 includes a diffraction grating of bending the laser beam toward the downstream side in the scanning direction. FIG. 5 shows an example where a diffraction grating 35D is provided on the emission surface of the sensor lens 35. The diffraction grating can bend the light beam at the angle indicated by:

$$\sin\theta = m\lambda/d \quad (1)$$

when the grid space is d, the light beam wavelength is λ, and the spectrum degree of the diffraction grating is m.

Figure 6:
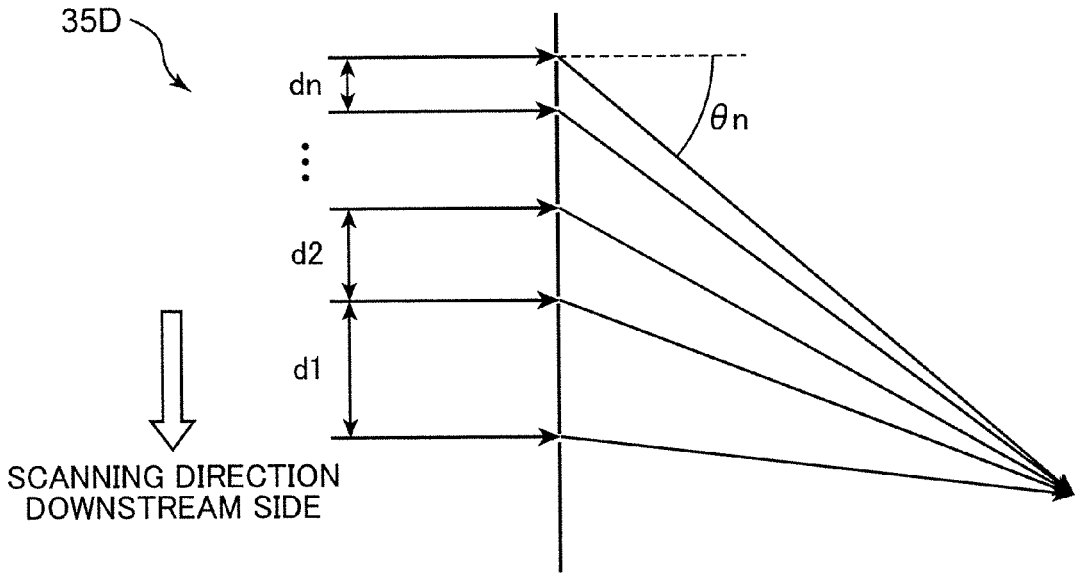
FIG. 6 is a schematic diagram showing the operation of the sensor lens including a diffraction grating.

FIG. 6 is a schematic diagram showing the configuration of the diffraction grating 35D. The grid space of the diffraction grating 35D becomes narrow toward the upstream side such that a grid space d1 on the downstream side in the scanning direction is the widest, and a grid space d2 that is adjacent to the upstream side of the grid space d1 is the narrower than d1. To put it differently, the grid space of the diffraction grating 35D is set to be broader from the upstream side toward the downstream side in the scanning direction. Based on Formula (1) above, when the grid space d changes, the bending angle θn of the light beam also changes. Since the grid space gradually changed according to the imaged height as described above, the diffraction grating 35D can consequently bend the light beams and converge the light beams at a single point. Moreover, the conversion point may be set at the intended position by adjusting the grid space d.

In addition, based on Formula (1) above, when the wavelength λ of the light beam changes, the bending angle θn of the light beam also changes. As described above, the wavelength of the laser beam emitted from the first LD module 31 becomes longer with the increase in the environmental temperature. Accordingly, when the temperature rises, the bending angle θn of the light beam increases. In other words, the conversion point of the light beams will shift more toward the downstream side in the scanning direction. This implies that the timing at which the laser beam enters the synchronizing sensor 36 changes based on the environmental temperature. This point is now explained with reference to FIG. 5.

For the sake of convenience in providing the explanation, when it is assumed that the light beam L11 on the uppermost stream side enters the sensor lens 35, the light beam L11 is bent to the downstream side in the scanning direction by the diffraction grating 35D. Let it be assumed that the bending angle of the light beam when the environmental temperature is a normal temperature is θA, the bending angle of the light beam during a high temperature that increase a predetermined temperature from the normal temperature is θB, and the light beams after the light beam L11 is bent at the respective bending angles are L12A, L12B, respectively. In the foregoing case, θA<θB. Thus, a phenomenon where, while the light beam L12A does not enter the synchronizing sensor 36 during a normal temperature, the light beam L12B enters the synchronizing sensor 36 during a high temperature, occurs.

When the polygon mirror 26 is in a state of a certain rotation angle ϕ, let it be assumed that the laser beam L1 is deflected in the direction of the light beam L11. During a normal temperature, the light beam L12A cannot enter the synchronizing sensor 36 at the rotation angle ϕ, and the light beam L12A enters the synchronizing sensor 36 when the polygon mirror 26 is rotated up to the following rotation angle; namely, rotation angle ϕ+Δϕ. Meanwhile, during a high temperature, the light beam L12A can enter the synchronizing sensor 36 when the polygon mirror 26 is in the state of the rotation angle ϕ. The writing of the scanning line SL1 is started at the timing that a fixed time is added to the timing that the synchronizing sensor 36 detected the light beam. Accordingly, during a high temperature, the write start timing of the scanning line SL1 is sooner than during a normal temperature. Thus, when a magnification error occurs in the first and second scanning lenses 32, 33, this contributes to distributing the deviation in the scanning position caused by the foregoing magnification error to the write start side and the write end side of the scanning line SL1 (this will be described later with reference to FIG. 10).

The sensor lens 35 may be configured by providing a diffraction grating 35D on one side or both sides of a transparent tabular base material or a base material having lens power. While the diffraction grating 35D does not necessarily require lens power since it possesses the function of converging the light beams, in order to shorten the focal point distance and achieve downsizing, it is desirable to use a base material having lens power.

A specific example of the sensor lens 35 is illustrated. The entrance surface of the sensor lens 35 is configured as a spherical surface, and the emission surface is configured as a diffraction surface. The curvature radius of the spherical surface is set to −9.2054. The diffraction surface is configured to have a degree of 1, normalized wavelength of 786 nm, primary phase coefficient of −0.8278, secondary phase coefficient of 0.0336, and tertiary phase coefficient of −0.0056. With regard to the grid space of the diffraction surface, the grid space d1 on the downmost stream side in the scanning direction is set to 1.9 μm, and the grid space do on the uppermost stream side is set to 1.6 μm, and the design is such that the grid space gradually decreases from the downstream side toward the upstream side. The grid space will suffice so as long as it is of a decreasing tendency from the downstream side toward the upstream side, and it may also be a mode where the grid space gradually decreases in units of a plurality of gratings.

Figure 7:
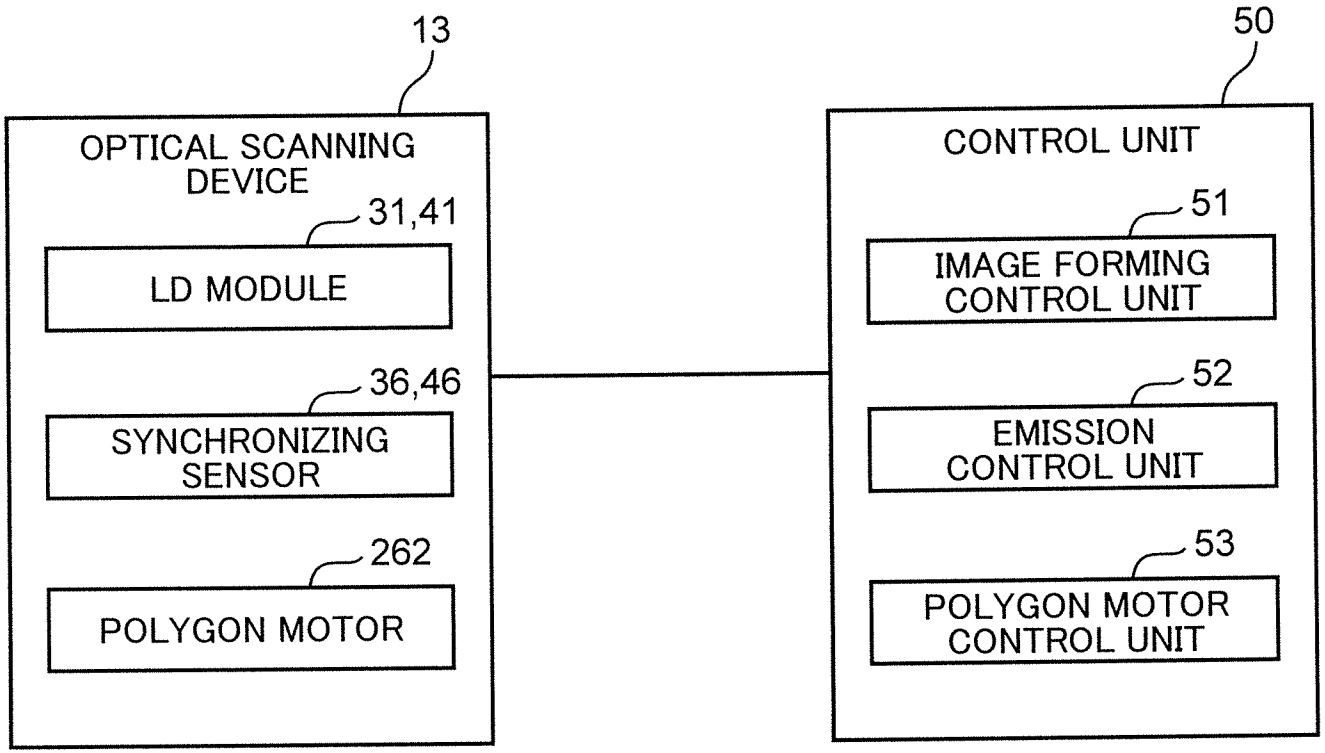
FIG. 7 is a block diagram showing a control configuration of the optical scanning device.

FIG. 7 is a block diagram showing the control configuration of the optical scanning device 13. The printer 1 includes a control unit 50 for controlling the operation of the optical scanning device 13 and other devices. The control unit 50 is a microcomputer that is operated with control programs, and functionally includes an image forming control unit 51, an emission control unit 52 (control unit), and a polygon motor control unit 53.

The image forming control unit 51 controls the image forming operation of the printer 1. The image forming control unit 51 sets the process line speed, and sets the rotating speed of the photoconductive drums 2*a* to 2*d* and the rotating members including the intermediate transfer belt 7 to match the process line speed. The image forming control unit 51 operates the image forming units 1M, 1C, 1Y, 1Bk, the optical scanning device 13, and the fixing device 22 so as to control the transfer of the toner image onto the sheet and the fixing operation.

The emission control unit 52 controls the emission operation of the first LD module 31 (second LD module 41). The emission control unit 52 controls the emission operation of the laser diode of the first LD module 31 according to the image data provided for the image forming of the respective colors. The emission control unit 52 starts the writing of the scanning line SL1 on the peripheral surface of the photoconductive drum 2*a* at a timing obtained by adding a fixed time to the timing that the synchronizing sensor 36 detected the light beam. Note that the fixed time is not changed regardless of whether it is during the normal temperature or during the high temperature described above.

The polygon motor control unit 53 controls the drive of the polygon motor 262 in order to control the rotating speed of the polygon mirror 26 about the axis.

Figure 8:
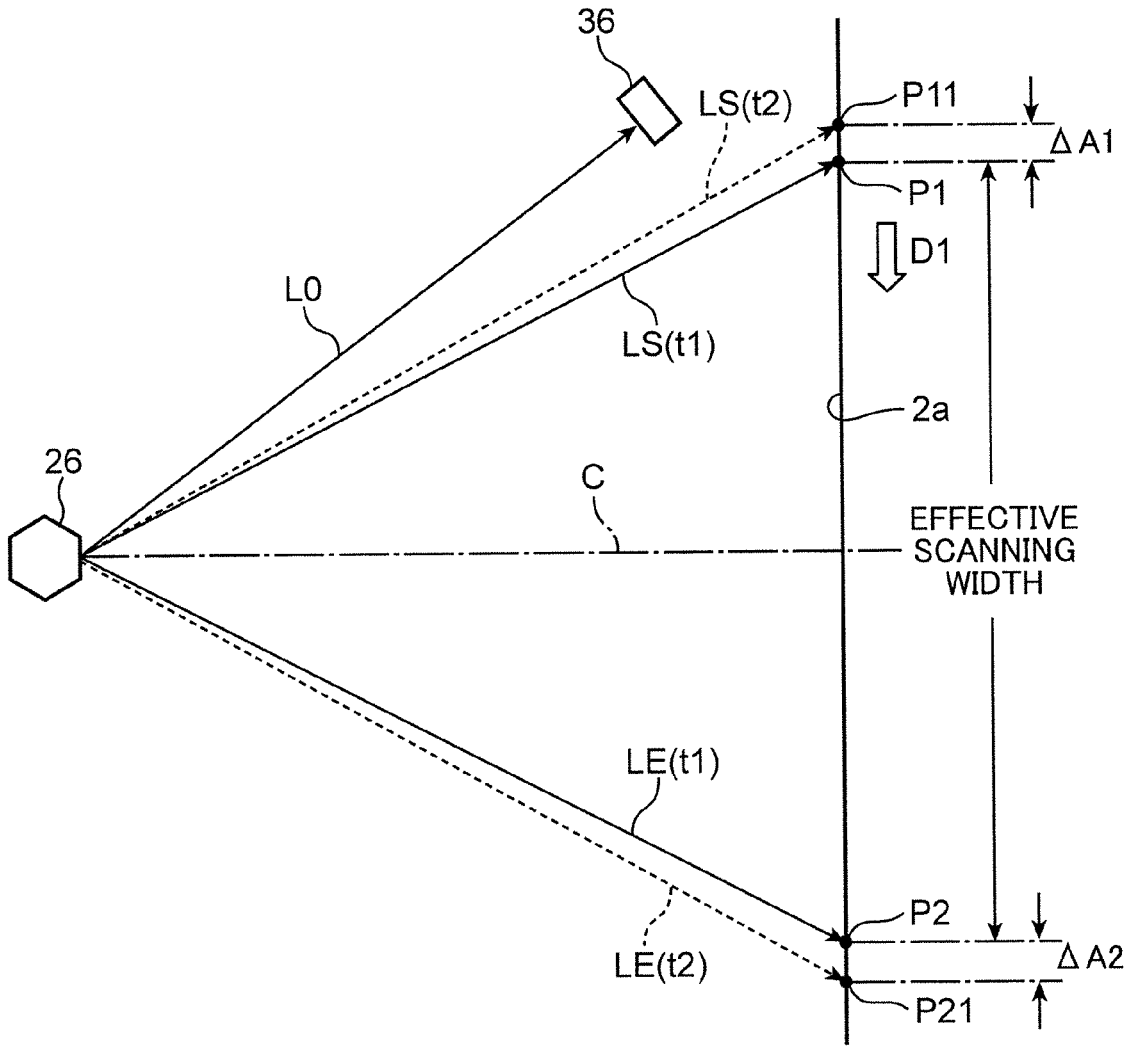
FIG. 8 is an explanatory diagram of the magnification error.

The generation status of a magnification error in a scanning optical system and the distribution status of a magnification error by the optical scanning device 13 of this embodiment are now explained. FIG. 8 is an explanatory diagram of the magnification error. Here, in order to simplify the diagram, illustration of the first and second scanning lenses 32, 33 is omitted. During a normal temperature (temperature=t1), let it be assumed that the effective scanning width is fixed based on the light beam LS(t1) on the uppermost stream side and the light beam LE(t1) on the downmost stream side in the scanning direction. The timing (write start timing) in which the light beam LS is generated is the timing in which a fixed time is added to the timing that the synchronizing sensor 36 detected the light beam L0; that is, the timing after the polygon mirror 26 rotates in an amount corresponding to a predetermined rotation angle ϕA.

During a high temperature (temperature=t2, t1<t2), as described above, the lens power of the first and second scanning lenses 32, 33 decreases. Consequently, the magnification of the first and second scanning lenses 32, 33 will change and, when no consideration is given to the write start timing, the effective scanning width will expand toward the outside from the scanning width center C both on the upstream side and the downstream side in the scanning direction. In other words, while the light beam LS(t1) on the uppermost stream side was being imaged at the point P1 on the peripheral surface of the photoconductive drum 2*a*, the light beam LS(t2) during a high temperature is imaged at the point P11 on a side that is more upstream than the point P1. A scanning deviation ΔA1 is consequently generated on the upstream side of the effective scanning width. Similarly, while the light beam LE(t1) on the downmost stream side was being imaged at the point P2 on the peripheral surface of the photoconductive drum 2*a*, the light beam LE(t2) during a high temperature is imaged at the point P21 on a side that is more downstream than the point P2. A scanning deviation ΔA2 is consequently generated on the downstream side of the effective scanning width.

Figure 9:
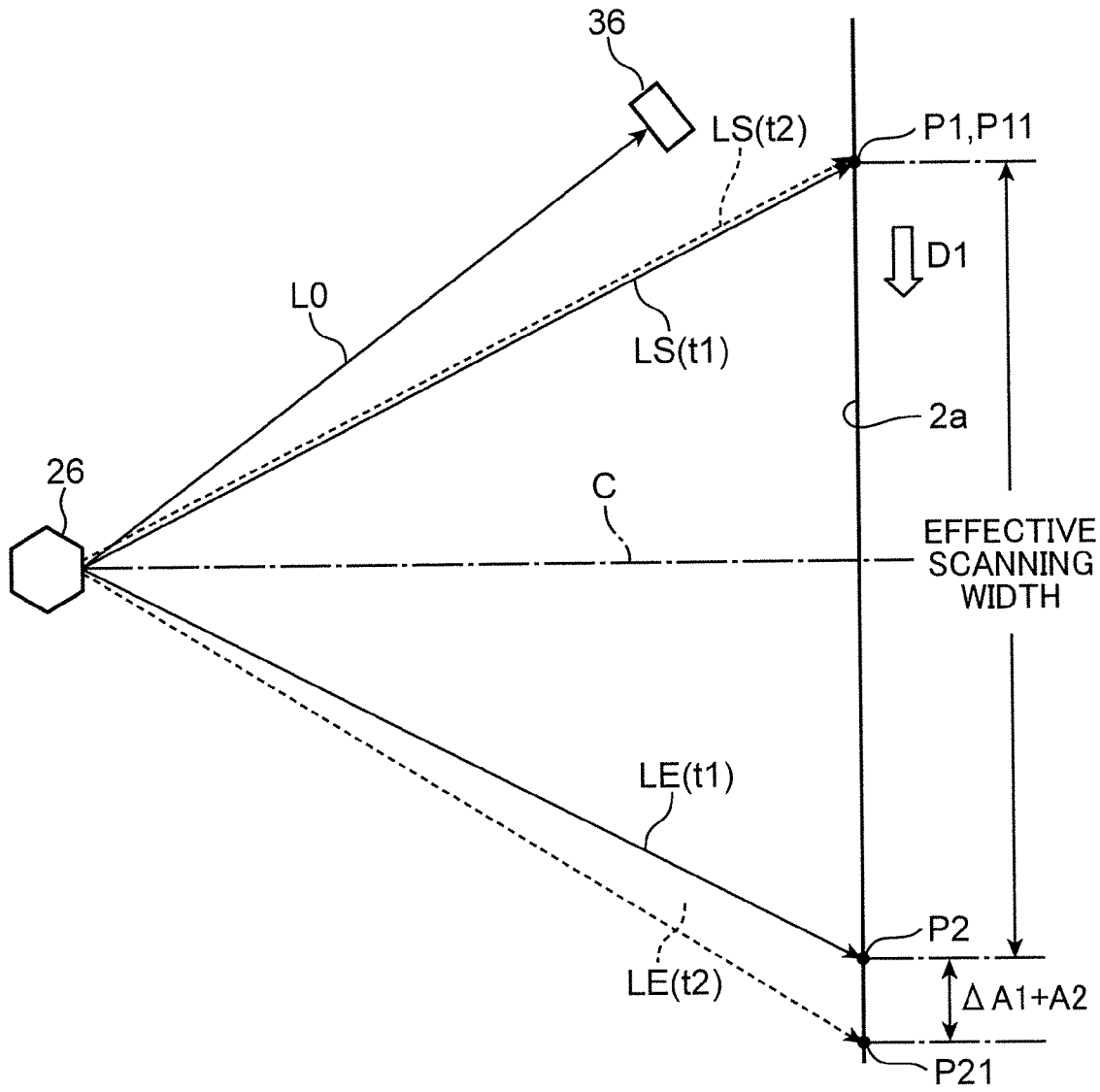
FIG. 9 is an explanatory diagram showing a generation status of the magnification error in a Comparative Example.

FIG. 9 is an explanatory diagram showing the generation status of a magnification error in an optical scanning device of the Comparative Example; that is, an optical scanning device that does not include the sensor lens 35. As described above, the write start timing in which the light beam LS(t1) is generated is the timing obtained by adding a fixed time to the timing that the synchronizing sensor 36 detected the light beam L0. This control mode is the same during a high temperature. Thus, the write start timing in which the light beam LS(t2) is generated during a high temperature is the same as the light beam LS(t1) during a normal temperature. In other words, the imaging position (write start position) of point P1 and point P11 on the peripheral surface of the photoconductive drum 2*a* is the same.

Accordingly, the scanning deviations ΔA1, ΔA2 shown in FIG. 8 will appear disproportionately on the downstream side of the effective scanning width. In other words, based on the magnification change of the first and second scanning lenses 32, 33, the scanning width when the polygon mirror 26 is rotated at a rotation angle corresponding to the distance between point P1 and point P2 during a normal temperature is expanded by a scanning deviation ΔA1 on the upstream side and by a scanning deviation ΔA2 on the downstream side. Since the write start position is constant during the normal temperature and during the high temperature, the scanning deviations ΔA1 and ΔA2 will appear as scanning deviation ΔA1+ΔA2 only on the downstream side as shown in FIG. 9. Consequently, the scanning width center of the light beam LS(t2) and the light beam LE(t2) will shift to the downstream side relative to the scanning width center C of the light beam LS(t1) and the light beam LE(t1).

This shifting of the scanning width center C causes a considerable color drift in a counter scanning system. As explained with reference to FIG. 4, the scanning line SL1 written on the magenta photoconductive drum 2*a* and the scanning line SL2 written on the cyan photoconductive drum 2*b* are of opposite scanning directions. Thus, the scanning width center of the scanning line SL1 will shift to the left side and the scanning width center of the scanning line SL2 will shift to the right side. Accordingly, when the images written based on both scanning lines are superimposed, the dots that should have overlapped with each other become separated, and generate a color drift.

Figure 10:
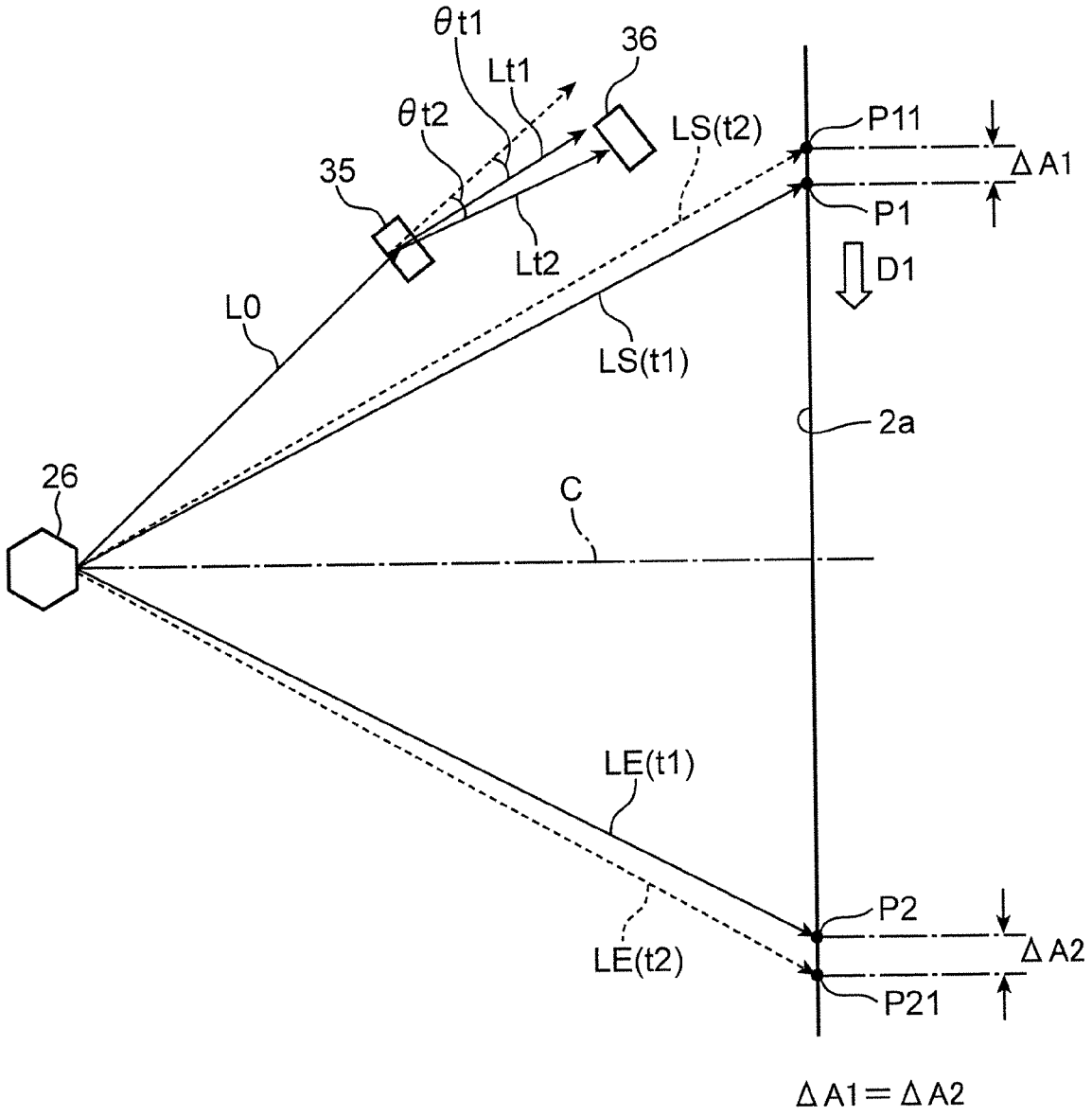
FIG. 10 is an explanatory diagram showing a distribution status of the magnification error in an Example.

FIG. 10 is an explanatory diagram showing the distribution status of the magnification error in this embodiment. According to this embodiment in which a sensor lens 35 including a diffraction grating is provided, the foregoing scanning deviations ΔA1, ΔA2 can be respectively distributed to the upstream side and the downstream side in the scanning direction. Here, let it be assumed that, when the polygon mirror 26 is of a rotation angle ϕ, the light beam L0 within the scannable width enters the sensor lens 35. During a normal temperature (t1), the light beam L0 that entered the sensor lens 35 is bent by the diffraction grating and becomes the light beam Lt1 that is bent to the downstream side in the scanning direction at the bending angle θt1. The light beam Lt1 cannot enter the synchronizing sensor 36 at the rotation angle θ.

The light beam Lt1 will enter the synchronizing sensor 36 when the polygon mirror 26 rotates up to the following rotation angle; namely, rotation angle ϕ+Δϕ1. When the polygon mirror 26 thereafter rotates at a rotation angle Δϕ2 corresponding to a predetermined fixed time, the emission control unit 52 starts the lighting control of the first LD module 31 for drawing the scanning line SL1 (write start timing). In other words, the light beam LS(t1) is generated, and exposure is started from the point P1. Subsequently, the emission control unit 52 continues the lighting control until the polygon mirror 26 additionally rotates at a rotation angle Δϕ3 corresponding to the effective scanning width, and ends the lighting control at the point P2 corresponding to the light beam LE(t1) (write end timing). To summarized the above, during a normal temperature, when the light beam L0 is used as the reference, the write start timing is the time that the polygon mirror 26 rotated at a rotation angle ϕ+Δϕ1+Δϕ2, and the write end timing is the time that the polygon mirror 26 additionally rotated at a rotation angle Δϕ3.

Meanwhile, during a high temperature (t2), the light beam L0 that entered the sensor lens 35 becomes, based on the foregoing operation of the diffraction grating, the light beam Lt2 that is bent to the downstream side in the scanning direction at a bending angle θt2 (θt1<θt2). This light beam Lt2 enters the synchronizing sensor 36 at the rotation angle ϕ. When the polygon mirror 26 thereafter rotates at a rotation angle Δϕ2 corresponding to a predetermined fixed time, the emission control unit 52 starts the lighting control of the first LD module 31 for drawing the scanning line SL1 (write start timing). Consequently, the light beam LS(t2) is generated, and exposure is started from the point P11. This write start timing is sooner by a rotation angle 41 of the polygon mirror 26 in comparison to the case during a normal temperature. Thus, the point P11 shifts more to the upstream side in the scanning direction (arrow D1) than the point P1.

Subsequently, the emission control unit 52 continues the lighting control until the polygon mirror 26 additionally rotates by a rotation angle Δϕ3 corresponding to the effective scanning width, and ends the lighting control at the point P21 corresponding to the light beam LE(t2) (write end timing). Here, shown is an example where the point P21 is shifted more to the downstream side in the scanning direction than the point P2 due to the influence of the magnification error. To summarize the above, during a high temperature, the write start timing is the time that the polygon mirror 26 rotated at a rotation angle $\phi+\Delta\phi 2$, and the write end timing is the time that the polygon mirror 26 additionally rotated at a rotation angle $\Delta\phi 3$.

In this embodiment, since the write start timing during a high temperature will be sooner by the rotation angle $\Delta\phi 1$ in comparison to a case during a normal temperature, a part of the expanded portion of the effective scanning width caused by the magnification error can be distributed to the upstream side of the effective scanning width. Thus, according to the optical scanning device 13 of this embodiment, it is possible to suppress the generation of a color drift in comparison to the optical scanning device of the Comparative Example in which the expanded portion of the effective scanning width appears disproportionately on the downstream side of the effective scanning width.

Particularly, the diffraction grating 35D of the sensor lens 35 is preferably configured to have a grating structure capable of evenly distributing the expanded portion of the effective scanning width, resulting from the decrease in the lens power caused by the rise in temperature of the first and second scanning lenses 32, 33, to the scanning start side and the scanning end side of the scanning line SL1. Specifically, the grid space of the diffraction grating 35D is desirably set by obtaining, in advance, the relation of the grid space of the diffraction grating 35D and the displacement of the bending angle caused by the temperature change, and so that the level of quickening the entry of the light beam into the synchronizing sensor 36 (temperature characteristics of foregoing $\Delta\phi 1$) and the temperature characteristics of the expanded portion of the effective scanning width caused by the magnification error will coincide. In the foregoing case, the scanning deviation $\Delta A1$ between the point P1 and the point P11 and the scanning deviation $\Delta A2$ between the point P2 and the point P21 will be the same. Thus, the scanning width center C can be kept at the same position before and after the occurrence of a magnification error, and the generation of a color drift can be suppressed to a minimum in a counter scanning system.

According to the optical scanning device 13 of this embodiment explained above, a sensor lens 35 including a diffraction grating 35D is disposed on the optical path and between the polygon mirror 26 and the synchronizing sensor 36. The diffraction grating 35D bends the laser beam toward the downstream-side of the scanning direction, and the bending degree thereof changes with the temperature. Thus, even when a magnification error occurs in the first and second scanning lenses 32, 33 due to a change in the environmental temperature, the timing that the laser beam enters the synchronizing sensor 36; that is, the write start timing, can be appropriately adjusted with the sensor lens 35 according to the temperature. It is thereby possible to distribute the scanning deviation associated with the magnification error to the upstream side and downstream side of the effective scanning width, and minimize the deterioration in the image quality caused by a color drift.

While embodiments of the present disclosure were explained above, the present disclosure is not limited thereto. For example, the present disclosure may also adopt the following modified embodiments.

(1) The foregoing embodiment illustrated a two-color sharing counter scanning system in which the scanning optical systems 30, 40 of two colors are housed in one optical scanning device 13. Alternatively, a four-color sharing counter scanning system in which the scanning optical system of four colors are housed in one optical scanning device may also be used.

(2) The foregoing embodiment illustrated a full color printer 1 as the image forming apparatus. Alternatively, the present disclosure may also be applied to a black-and-white printer or copier. In other words, the optical scanning device 13 may be configured as a single-color system.

(3) The foregoing embodiment illustrated a polygon mirror 26 as the deflector. Alternatively, another deflector, for instance, an MEMS mirror may also be adopted. Moreover, while the foregoing embodiment illustrated an example where the first and second scanning optical systems 30, 40 each include two scanning lenses, the scanning optical systems may also be configured from one scanning lens.

(4) The foregoing embodiment illustrated an example of the laser beam that passed through both the first and second scanning lenses 32, 33 entering the synchronizing sensor 36 with reference to FIG. 3. Alternatively, the configuration may also be such that the laser beam that passed through only the first scanning lens 32 enters the synchronizing sensor 36. In the foregoing case, the configuration may be such that the laser beam outside the range of the effective scanning width between the first scanning lens 32 and the second scanning lens 33 is extracted, and the reflected laser beam enters the synchronizing sensor 36. However, when both the first and second scanning lenses 32, 33 have power in the main scanning direction, it is preferable to adopt the configuration of the foregoing embodiment in which the laser beam that passed through both the first and second scanning lenses 32, 33 enter the synchronizing sensor 36.

As described above, according to the present disclosure, it is possible to accurately suppress the influence from the magnification error of the scanning lens without having to adopt a complicated structure. Accordingly, it is possible to provide an optical scanning device and an image forming apparatus with superior image quality.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An optical scanning device, comprising:

a light source that emits a light beam having a wavelength that changes with temperature;

a deflector that deflects the light beam emitted from the light source and causes the light beam to scan a range of a predetermined scannable width including a surface to be scanned, and causes a scanning line to be written within an effective scanning width that is set within the range of the scannable width;

a scanning lens that is disposed between the deflector and the surface to be scanned, and images the light beam on the surface to be scanned;

a synchronizing sensor that detects, of light beams that pass through the scanning lens and head toward the range of the scannable width, a light beam that is outside the range of the effective scanning width on a scanning start side of the scanning line;

a sensor lens that is disposed between the deflector and the synchronizing sensor, the sensor lens being configured to allow the light beam to pass therethrough and to image the light beam on the synchronizing sensor; and a control unit that controls an emission operation of the light source, and starts the writing of the scanning line at a timing in which a fixed time is added to a timing that the synchronizing sensor has detected the light beam, wherein the sensor lens includes a diffraction grating that bends the light beam that passes through the sensor lens in a downstream-side direction of the scanning line, and a bending degree of the light beam by the diffraction grating changes with temperature.

2. The optical scanning device according to claim 1, wherein a grid space of the diffraction grating is set to be broader toward a downstream side from an upstream side in a scanning direction.

3. The optical scanning device according to claim 1, wherein the wavelength of the light beam emitted by the light source becomes longer as the temperature rises, and the scanning lens is a lens having a lens power that decreases as the temperature rises.

4. The optical scanning device according to claim 3, wherein the diffraction grating has a grating structure that equally distributes, to a scanning start side and a scanning end side of the scanning line, an expanded portion of the effective scanning width associated with the decrease of the lens power.

5. An image forming apparatus, comprising:

a first photoconductive drum having a first peripheral surface as surfaces to be scanned, and rotating about an axis;

a second photoconductive drum having a second peripheral surface as surfaces to be scanned, and rotating about an axis;

a first optical scanning device that is configured from the optical scanning device according to claim 1 and that causes the first peripheral surface to be irradiated with a light beam, and a second optical scanning device that is configured from the optical scanning device according to claim 1 and that causes the second peripheral surface to be irradiated with a light beam, wherein in the first optical scanning device, the first peripheral surface is scanned with the light beam in a first direction that is a main scanning direction, and in the second optical scanning device, the second peripheral surface is scanned with the light beam in a second direction that is opposite to the first direction.

6. The image forming apparatus according to claim 5, wherein the first optical scanning device and the second optical scanning device are disposed to face each other across one deflector, and share the one deflector.

* * * * *